US005452486A

United States Patent [19]

Czako

[11] Patent Number: 5,452,486

[45] Date of Patent: Sep. 26, 1995

[54] INFLATABLE LIFTING DEVICE FOR THE BEDRIDDEN

[76] Inventor: Josef Czako, 4633 No. 3 Road, Yarrow, BC, V0X 2A0, Canada

[21] Appl. No.: 262,121

[22] Filed: Jun. 17, 1994

[51] Int. Cl.[6] ..... A61G 7/10

[52] U.S. Cl. ..... 5/81.1; 5/455

[58] Field of Search ..... 5/81.1, 453, 455, 5/615, 660, 449

[56] References Cited

U.S. PATENT DOCUMENTS

| | | | |
|---|---|---|---|
| 3,477,071 | 11/1969 | Emerson . | |
| 3,485,240 | 12/1969 | Fountain | 5/456 |
| 3,492,988 | 2/1970 | De Mare . | |
| 3,775,781 | 12/1973 | Bruno et al. | 5/81.1 |
| 3,781,928 | 1/1974 | Swallert . | |
| 3,895,403 | 7/1975 | Davis | 5/81.1 |
| 4,142,263 | 3/1979 | Pierson . | |
| 4,574,412 | 3/1986 | Smith | 5/632 |
| 4,905,329 | 3/1990 | Heilner | 297/DIG. 3 |
| 4,941,221 | 7/1990 | Kanzler . | |
| 4,953,247 | 9/1990 | Hasty | 5/455 |
| 4,977,629 | 12/1990 | Jones | 5/455 |
| 5,092,007 | 3/1992 | Hasty | 5/453 |
| 5,121,512 | 6/1992 | Kaufman | 5/453 |
| 5,142,720 | 9/1992 | Kelso et al. | 5/630 |

*Primary Examiner*—Alexander Grosz

[57] ABSTRACT

An apparatus to assist in the lifting of a patient. The apparatus has an inflatable body in two parts. A first part raises an upper part of the patient and a second part inclines the lower part of the patient. There is an envelope extending longitudinally from one side of the first part and laterally remote from the first part. In this way a sequential lifting of the patient can be achieved. First by lifting the upper part and secondly by gently tipping the legs, lower part or torso of the patient outwardly.

3 Claims, 1 Drawing Sheet

INFLATABLE LIFTING DEVICE FOR THE BEDRIDDEN

FIELD OF THE INVENTION

This invention relates to an apparatus to assist in the lifting of a patient.

DESCRIPTION OF THE PRIOR ART

The lifting of a patient is a difficult task for a nurse or home-help to carry out. Frequently the patient cannot give any assistance at all and the weight of a human body is substantial.

As a result there have been a substantial number of suggestions to assist in the lifting of a patient. The patient may be a bed-ridden invalid, or may be temporarily unable to assist himself or herself, perhaps as the result of an accident.

Prior art known to applicant includes U.S. Pat. Nos. 4,941,221 to Kanzler; 3,492,988 to De Mare; 4,142,263 to Pierson; 3,781,928 to Swallert; 3,775,781 to Bruno et al.; 4,905,329 to Heilner; 5,142,720 to Kelso et al.; 5,121,512 to Kaufmann; 3,477,071 to Emerson and 3,895,403 to Davis.

Of the above patents Kanzler is a body supporting apparatus. There are separate compartments in Kanzler all operable in the same plane. That is Kanzler simply lifts the patient on inflation and lowers the patient on deflation. Kanzler also shows the notion of tipping the whole body.

De Mare uses a drive of gears, cams and worm drives to raise and lower a patient. Again, like Kanzler, De Mare shows the ability to tip the patient side-ways.

Bruno et al. is directed to a device for partial turning of a patient. Two inflatable mattresses are arranged on a bed. Valving is used to determine the flow.

Heilner is an inflatable seat cushion. It is used to assist the patient to rise from a seated position but not from a prone position.

Pierson is a device that raises the upper part of the patient and essentially is concerned with the upward and downward movement of a patient.

Swallert uses a pneumatic device to raise and lower a rigid mattress formed with a joint.

Davis is a body turning device. The idea is to tilt a patient by the use of inflatable bodies.

Kelso teaches a positioning device and a method of using the device. Kelso is a relatively small piece of equipment that fits beneath a patient's hips and assists in turning a patient.

Kaufmann again is used for tilting a patient and Emerson relates to an automatic shifting of a patient. Emerson teaches a mattress of simple structure but with quite complicated controls for the shifting of the patient.

All of the prior art raises or lowers the patient or tips the patient. However, no prior art known to applicant shows the notion of assisting a patient from the bed, for example to transfer to a wheel-chair. The present invention provides apparatus able to perform this function.

SUMMARY OF THE INVENTION

Accordingly, the present invention provides an apparatus to assist in the lifting of a patient comprising, an inflatable body in two parts; a first part to raise an upper part of the patient; a second part to incline the lower part of the patient and comprising an envelope extending longitudinally from one side of the first part and laterally remote from the first part.

DESCRIPTION OF THE DRAWINGS

The invention is illustrated in the drawings in which.

DESCRIPTION OF THE PREFERRED EMBODIMENTS

Figure 1:
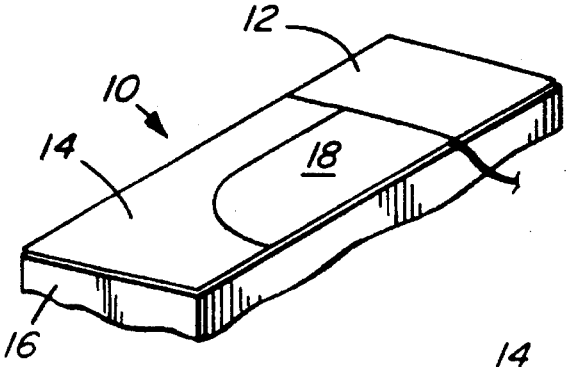
FIGS. 1 to 5 show the apparatus of the present invention in a series of sequences to demonstrate both the structure and function of the apparatus.

The drawings show apparatus to assist the lifting of a patient. The apparatus comprises an inflatable body 10 formed with a first part 12 and a second part 14. In the drawings the apparatus of the present invention is shown mounted on a bed 16. There are valves provided and a small pump or compressor (not shown) will be used. The upper or first part 12 of the body 10, on inflating, raises the head of the patient. Its mode of operation is comparable to the prior art. That is to say the patient is moved upwardly, without inclination to either side.

The essence of the present invention is provided by the second part 14. The second part 14 again is inflatable and comprises an envelope extending longitudinally from one side of the first part 12 and laterally at a position remote from the first part 12, that is to say part 14 has a generally L-shaped configuration.

Figure 3:
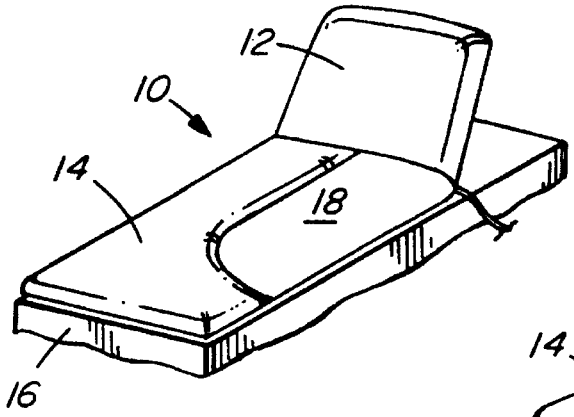

In the embodiment of the present invention, the second part 14 comprises a rectangular body but the area 18 is not inflatable or is only inflatable to a small degree, for example to provide cushioning for the patient. However, and as shown particularly in Figures 3, 4 and 5 the generally L-shaped part is inflatable to raise and tip the lower part of the patient. By this means, with suitable assistance from a nurse or other third party, the patient can be gently eased from the bed.

Figure 2:
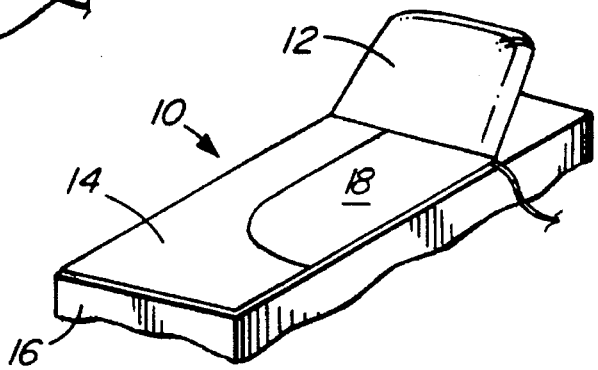
Figure 4:
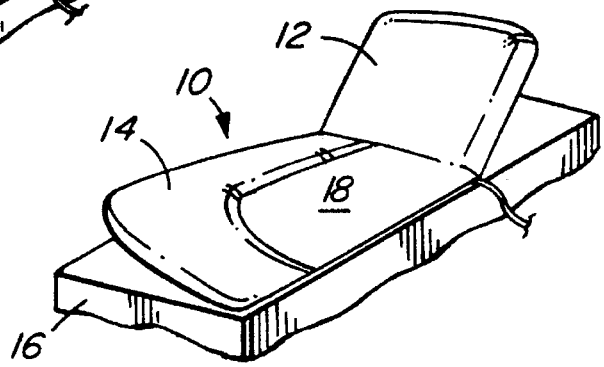
Figure 5:
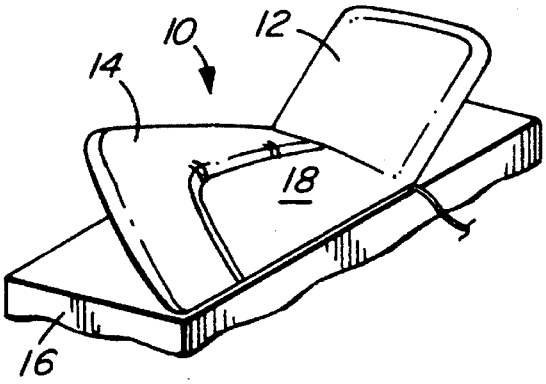

The apparatus functions as follows. Normally the body 10 will be moved into place beneath the patient when it is desired to assist the patient from the bed 16. However, it is perfectly feasible to leave the apparatus as a mattress, in the position shown in FIG. 1. Furthermore, if the patient desires simply to lift the head, for example for reading, then the FIG. 2 shape, in which the first part 12 only is inflated and raised can be used to support the head of the patient. However, when it is desired to assist the patient from the bed, the first part 12 is inflated, as shown in FIG. 2 and in FIG. 3. Once the first part 12 is raised the second part 14 is inflated. This part 14 functions by virtue of its shape first to lift the legs and torso of the patient —the FIG. 3 position. As additional pressure is applied to the second part 14 it tends to incline, as shown in FIG. 4. Thus the legs of the patient are moved gradually to the patients's left, as shown in FIG. 4. Finally, and as shown in FIG. 5, the second part 14 is fully inflated and the patient can be eased readily from the bed without requiring great strength.

Inflation can be carried out either by the provision of separate valves, one for the first part 12 and one for the second 14, or by the use of a sequential valve which will first raise the first part 12 to a particular pressure. When part 12 is raised, the valve automatically directs air to the second part 14. Separate valves have the virtue of simplicity.

The present invention may be made of a plastic. It can be made, for example, of polyvinyl chloride or polyethylene of a gauge sufficient to provide strength. The device is light-weight, easily folded and can be carried with a patient.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. Apparatus to assist in the lifting of a patient lying on a bed comprising:

an inflatable body in two separate parts, adapted to be positioned on a bed and being of sufficient size to support a patient's body;

a first part to raise an upper part of the patient;

a second generally L-shaped part to incline the lower part of the patient and comprising an envelope extending longitudinally from one side of the first part and laterally remote from the first part.

2. Apparatus as claimed in claim 1 in which the first and second parts can be inflated sequentially, the first part being inflated first.

3. Apparatus as claimed in claim 2 including separate inlets for the first and second parts.

* * * * *